US007866273B2

(12) United States Patent
Schlotterback et al.

(10) Patent No.: US 7,866,273 B2
(45) Date of Patent: Jan. 11, 2011

(54) BOAT MOORING DEVICE

(76) Inventors: Terry D. Schlotterback, 67 EMS T32C La., Leesburg, IN (US) 46538; Ryan D. Schlotterback, 1215 Backforty Cir., Warsaw, IN (US) 46582

( * ) Notice: Subject to any disclaimer, the term of this patent is extended or adjusted under 35 U.S.C. 154(b) by 36 days.

(21) Appl. No.: 12/381,124

(22) Filed: Mar. 5, 2009

(65) Prior Publication Data

US 2010/0224116 A1 Sep. 9, 2010

(51) Int. Cl.
*B63B 21/00* (2006.01)

(52) U.S. Cl. ..... 114/230.26; 24/130; 114/218

(58) Field of Classification Search ..... 114/218, 114/230.2, 230.26; 24/129 R, 130, 132 R, 24/134 R, 135 R, 136 R; 294/19.1
See application file for complete search history.

(56) References Cited

U.S. PATENT DOCUMENTS

| | | | | | |
|---|---|---|---|---|---|
| 1,385,645 | A | * | 7/1921 | Rosemeyer | 24/129 R |
| 1,548,765 | A | * | 8/1925 | Smith | 24/134 R |
| 1,859,143 | A | * | 5/1932 | Howe | 24/129 R |
| 2,051,330 | A | * | 8/1936 | Cooper | 24/134 R |
| 3,512,223 | A | | 5/1970 | Willinger | |
| 3,677,597 | A | | 7/1972 | Stipek | |
| 3,765,061 | A | | 10/1973 | Nash | |
| 3,841,685 | A | | 10/1974 | Kolodziej | |
| 3,861,346 | A | | 1/1975 | Pina | |
| 3,918,385 | A | | 11/1975 | Wallace | |
| 3,945,335 | A | | 3/1976 | Kratz | |
| 3,993,013 | A | | 11/1976 | Nunziato et al. | |
| 4,004,539 | A | | 1/1977 | Wesson | |
| 4,109,603 | A | | 8/1978 | Guthmann | |
| 4,200,053 | A | | 4/1980 | Vall | |
| 4,541,149 | A | * | 9/1985 | Jensen | 24/134 R |
| 4,661,077 | A | | 4/1987 | Griffith et al. | |
| 4,878,270 | A | * | 11/1989 | Westerkamp | 24/132 R |
| 4,912,816 | A | | 4/1990 | Brandt | |
| 4,912,817 | A | * | 4/1990 | Sandreid | 24/132 R |
| 5,398,634 | A | | 3/1995 | Eagan | |
| 5,586,514 | A | | 12/1996 | Yuscavage | |
| 5,634,421 | A | | 6/1997 | Velarde | |
| 5,799,602 | A | | 9/1998 | Trillo | |
| 5,931,112 | A | | 8/1999 | Lacan | |
| 6,109,198 | A | | 8/2000 | Hintz | |
| 6,163,936 | A | * | 12/2000 | Benoit | 24/130 |
| 6,401,309 | B1 | * | 6/2002 | Yang | 24/130 |
| 6,925,951 | B1 | | 8/2005 | DeLong | |
| 6,928,945 | B1 | | 8/2005 | Tebo, Jr. | |
| 2004/0177797 | A1 | | 9/2004 | Severdija | |
| 2007/0039538 | A1 | | 2/2007 | Scotti | |

* cited by examiner

*Primary Examiner*—Lars A Olson
(74) *Attorney, Agent, or Firm*—Bose McKinney & Evans LLP

(57) ABSTRACT

A boat mooring device adapted to secure a watercraft to a mooring post with a rope. The device includes a rigid member forming a loop circumscribing a central opening. A passageway for receiving a rope within the rigid member extends between first and second ports. The rigid member prevents direct contact between the mooring post and a rope positioned within the passageway. A locking member moveable between first and second positions is disposed on the rigid member. In the first position, the locking member allows sliding movement of the rope through the passageway in a first direction from the first port toward the second port and inhibits sliding movement of the rope in a second direction from the second port toward the first port. In the second position, the locking member allows sliding movement of the rope in both the first direction and the second direction.

20 Claims, 3 Drawing Sheets

BOAT MOORING DEVICE

BACKGROUND OF THE INVENTION

1. Field of the Invention

The present invention relates to devices that can be used when mooring a boat and, more specifically, to such a device that is particularly well-suited for use with relatively small recreational watercraft.

2. Description of the Related Art

It is common for boats to be moored to a dock or pier with one or more ropes by securing one end of the ropes to a cleat or similar structure on the boat and securing the opposite end of the rope to a mooring post, cleat, piling or other structure located on or adjacent to the dock or pier. This often requires that one or more knots be formed in the rope. While skilled and experienced boatmen may be able to easily tie the appropriate knots for mooring a boat, many persons who find it necessary to moor a boat are not sufficiently knowledgeable or skilled to tie an appropriate knot. Recreational boaters who own relatively small recreational watercraft are oftentimes among those who do not have significant experience tying appropriate knots.

Various boat mooring aids have been developed over the years and many of these aids can be used to moor a small recreational watercraft. While a variety of such boat mooring aids are known and available, there remains a need for a boat mooring device that can be inexpensively manufactured and which is simple to use.

SUMMARY OF THE INVENTION

The present invention provides a boat mooring device that simplifies the boat docking process and is particularly well-suited for use with relatively small recreational watercraft.

The invention comprises, in one form thereof, a boat mooring device adapted to secure a watercraft to a mooring post with a rope. The device includes a rigid member forming a loop circumscribing a central opening wherein the rigid member is mountable on the mooring post by inserting the mooring post through the central opening. The rigid member defines a passageway extending between first and second ports wherein the rope is extendable through the passageway and the first and second ports. The rigid member prevents direct contact between the mooring post and the rope positioned within the passageway. A locking member is disposed on the rigid member and is moveable between first and second positions relative to the rigid member. When the locking member is in the first position, the locking member allows sliding movement of the rope through the passageway in a first direction from the first port toward the second port and inhibits sliding movement of the rope in a second direction from the second port toward the first port. When the locking member is in the second position, the locking member allows sliding movement of the rope in both the first direction and the second direction.

In some embodiments, the locking member is biased toward the first position. The locking member can be integrally formed with the rigid member out of a molded polymeric material with the polymeric material forming a living hinge joining the locking member to the rigid member. In other embodiments, the locking member is rotatably secured to the rigid member with a separate biasing member urging the locking member toward the first position.

In still other embodiments, the locking member includes a plurality of inclined parallel ridges that extend substantially perpendicular to the central axis of the rope and which are capable of securing the rope relative to the device.

BRIEF DESCRIPTION OF THE DRAWINGS

The above mentioned and other features of this invention, and the manner of attaining them, will become more apparent and the invention itself will be better understood by reference to the following description of embodiments of the invention taken in conjunction with the accompanying drawings, wherein.

Figure 3:
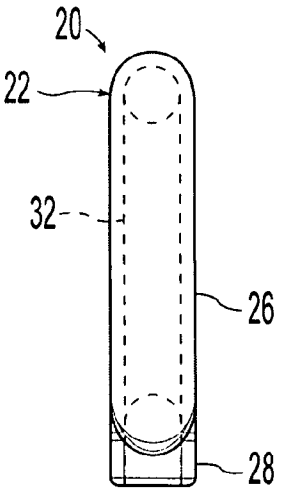
FIG. 3 is a side view of the boat mooring device.
Figure 5:
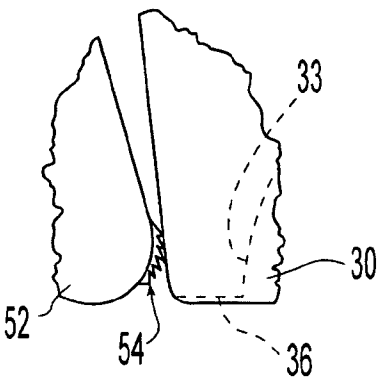
FIG. 5 is an enlarged view of the locking member of the boat mooring device.

Corresponding reference characters indicate corresponding parts throughout the several views. Although the exemplification set out herein illustrates embodiments of the invention, in several forms, the embodiments disclosed below are not intended to be exhaustive or to be construed as limiting the scope of the invention to the precise forms disclosed.

DETAILED DESCRIPTION OF THE INVENTION

A boat mooring device 20 in accordance with the present invention is shown in multiple views in FIGS. 1-5. Device 20 includes a shape-retaining rigid member 22 forming a loop that circumscribes a central opening 24. In the illustrated embodiment, member 22 has a substantially toroidal portion 26 forming the encircling loop and first and second projections 28, 30 extending outwardly from toroidal portion 26. Alternative embodiments of member 22, however, may form loops having alternative shapes that encircle a non-circular central opening 24.

Device 20 includes an interior passageway 32 that extends through toroidal portion 26 from a first port 34 to a second port 36. A rope 38 having a central axis 40 extends through passageway 32 and ports 34, 36. Rope 38 has a length 42 that extends outwardly from first port 34 and can be attached to a cleat 46 or similar attachment point on a watercraft 48. The opposite end 44 of rope 38 extends outwardly from second port 36.

When docking a watercraft 48, device 20 is secured to a mooring post 50 or similar structural member by passing the upper end of mooring post 50 through central opening 24 of device 20. With the first end 42 of rope 38 secured to watercraft 48 and device 20 positioned on mooring post 50, the free end 44 of rope 38 is then pulled to adjust the length of rope 38 between watercraft 48 and mooring post 50 to the desired length. A locking member 52 positioned on rigid member 22 allows the length of rope 38 between the watercraft 48 and mooring post 50 to be easily adjusted and then secured without having to tie a knot in rope 38.

Figure 2:
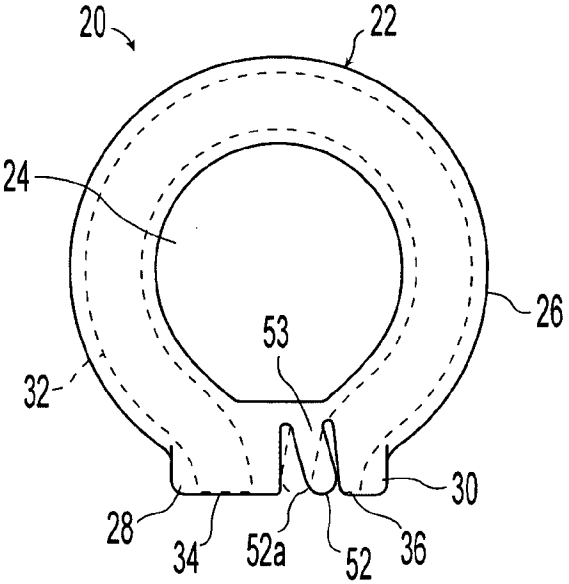
FIG. 2 is a top view of the boat mooring device.
Figure 4:
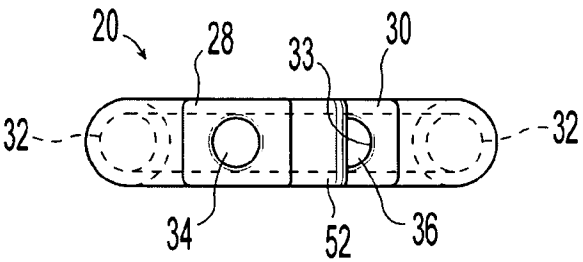
FIG. 4 is an end view of the boat mooring device.
Figure 1:
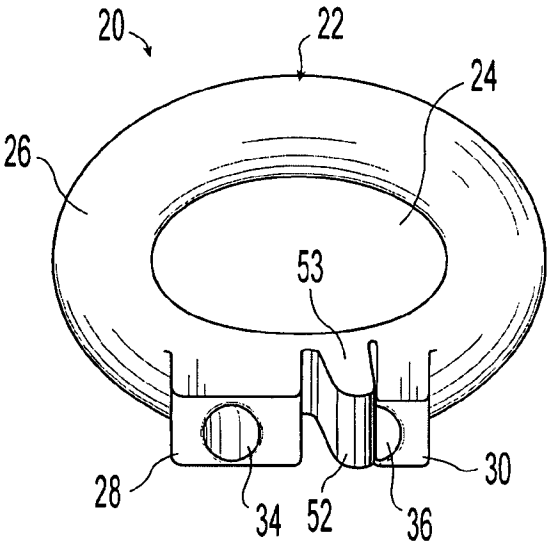
FIG. 1 is a perspective view of a boat mooring device.
Figure 5A:
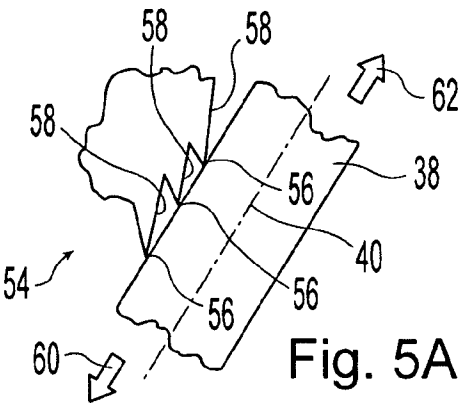
FIG. 5A is a further enlarged view of the locking member.
Figure 6:
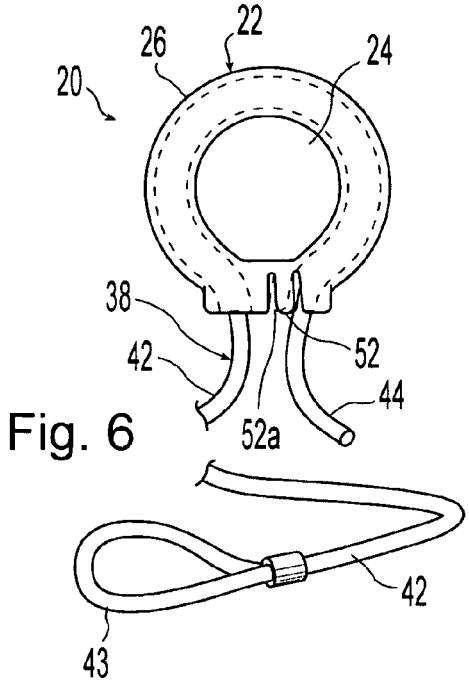
FIG. 6 is a view of the boat mooring device with a rope extending therethrough.

Locking member 52 is positioned on rigid member 22 near second port 36 and is moveable between a first locked position (indicated by solid lines in FIGS. 2 and 6) and a second disengaged position (indicated by dashed lines 52*a* in FIGS. 2 and 6). When the locking member 52 is in its locked position, it prevents rope 38 from sliding through passageway 32 from the second port 36 toward the first port 34 (direction 62 in FIG. 5A) but allows the rope 38 to slide within passageway 32 from the first port 34 toward the second port 36 (direction 60 in FIG. 5A). When locking member 52 is in its disengaged position it allows the rope 38 to slide in either direction within passageway 32. In other words, when locking member is in the locked position, rope 38 can be manually pulled by a boater through device 20 to decrease the length of section 42 and increase the length of section 44 but if watercraft 48 attempts to pull away from mooring post 50, locking member 52 will prevent rope 38 from being pulled through device 20 toward watercraft 48. When it is desired to increase the length of rope section 42 extending outwardly from first port 34, locking member 52 can be manually positioned in the disengaged position by the user.

Figure 7:
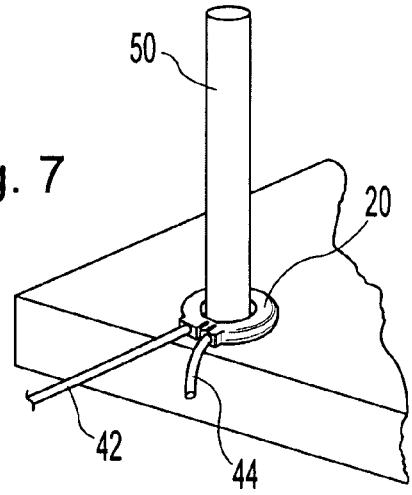
FIG. 7 is a view of the boat mooring device positioned on a mooring pole.
Figure 8:
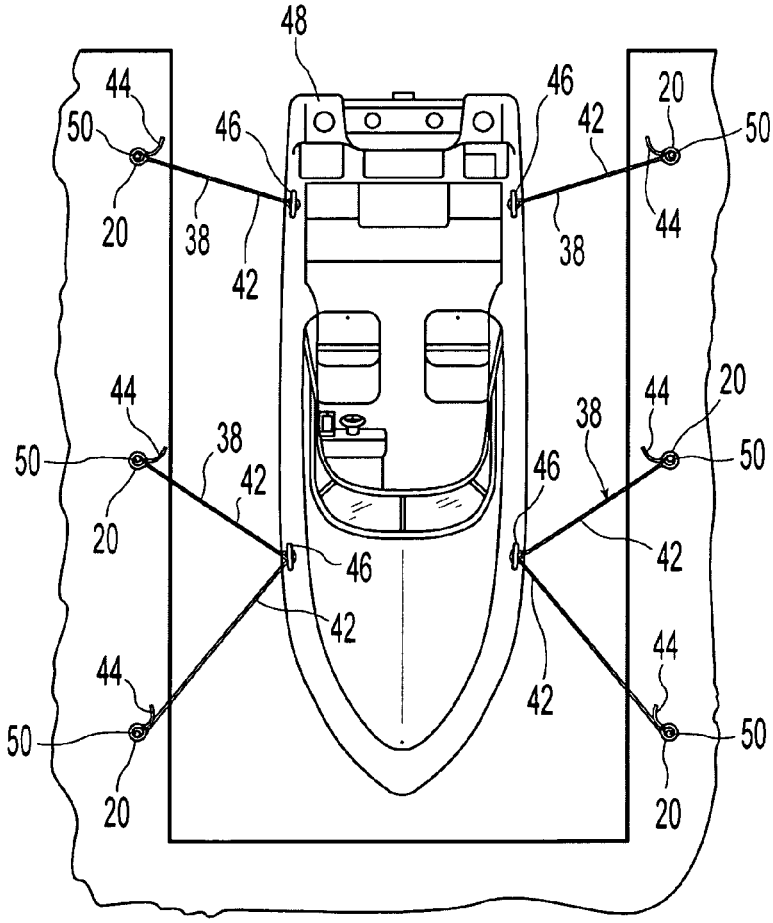
FIG. 8 is a view of a recreational watercraft moored to a pier using a plurality of the boat mooring devices.

FIG. 8 illustrates one example of how device 20 can be used to secure a watercraft 48 relative to a dock. In the situation depicted in FIG. 8, six devices 20 are placed on mooring posts 50 at different locations on the dock. FIG. 7 illustrates a device 20 mounted on a mooring post 50. The illustrated mooring posts 50 are similar in size to metal tubing used to form posts in conventional chain link fencing rather than telephone pole sized mooring posts.

Each of the devices 20 has a length of rope 38 inserted through passageway 32. Section 42 of ropes 38 are secured to cleats 46 on watercraft. By providing a preformed loop 43 on the end of section 42 of rope 38, the loop 43 can simply be placed around the cleat. This allows a user to secure watercraft 48 to the dock without having to tie a knot in rope 38 during the docking process. The length of each of the rope sections 42 for devices 20 is adjusted to secure watercraft at the desired location relative to the dock. The length of rope sections 42 can be easily shortened by simply pulling rope through device 20 to lengthen rope section 44 with locking member 52 in its locked position. Alternatively, rope section 42 can be lengthened by manually positioning locking member 52 in its disengaged position where it is spaced from rope 38 and pulling rope 38 in the opposite direction. The operation of locking member 52 which allows for this easy adjustment of the length of rope section 42 is discussed in greater detail below. Although it will generally be most convenient to place docking device on a mooring post located on a dock and attach rope section 42 extending from port 34 to watercraft 48, this can be reversed and device 20 can be mounted on a structure located on watercraft 48 with rope section 42 secured to the dock.

Rigid member 26 prevents rope 38 located within passageway 32 from directly contacting the mooring post 50 that extends through central opening 24. If device 20 were not being used, the rope would likely have to slide against the outer surface of the mooring post or other structural feature that is being used to secure watercraft 48. The friction between the rope and such structural feature can vary significantly depending upon the material characteristics of the structural feature. By avoiding direct engagement between rope 38 and mooring post 50, the friction generated when rope 38 slides through device 20 can be more easily controlled. The abrasive wear on rope 38 due to such sliding action can also be more easily controlled by having rope 38 slide against device 20 with its known physical properties. In the illustrated embodiment, passageway 32 fully encircles rope 38 between ports 34 and 36, however, it is not necessary for passageway 32 to fully encircle rope 38 for rigid member 26 to prevent direct engagement between rope 38 and mooring post 50.

Returning now to the operation of locking member 52, reference is made to FIG. 5A in which directional arrow 60 indicates movement of rope 38 in a first direction from first port 34 toward second port 36 (which shortens rope section 42) and directional arrow 62 indicates movement of rope 38 in a second direction from second port 36 toward first port 34 (which lengthens rope section 42). When locking member 52 is in its locking position, it engages rope 38 and prevents the sliding motion of rope 38 in direction 62 from second port 36 towards first port 34. The exact position of locking member 52 when it is in its first or locking position can vary and will depend in part on the diameter of rope 38.

The illustrated locking member 52 has a plurality of inclined parallel ridges 54 having edges 56 that extend substantially perpendicular to the central axis 40 of rope 38. (Edges 56 extend perpendicularly to the plane of FIGS. 5 and 5A.) Ridges 54 each terminate at an edge 56 with an inclined surface 58 leading to an associated one of the edges 56. When engaged with rope 38, inclined surfaces 58 face rope 38 and form an acute angle with the rope, extending away from the rope in the second direction 62. This configuration of ridges 54 allows rope 38 to slide against ridges 54 in first direction 60 when a user pulls on rope section 44 to shorten rope section 42. However, when rope 38 is pulled in direction 62 and ridges 54 are engaged with rope 38, edges 56 will tend to dig into rope 38 and prevent rope 38 from sliding in second direction 62.

More specifically, when ridges 54 are engaged with rope 38, rope 38 will be compressed between locking member 52 and an interior wall 33 of passageway 32 located opposite locking member 52. If a tension force is applied to rope 38 that pulls rope 38 in direction 62, the engagement of ridges 54 with rope 38 will cause locking member 52 to be drawn toward interior wall surface 33 and exert a greater compressive force on rope 38. This compressive force provides a secure engagement between locking member 52 and rope 38 as the tension force is applied to rope 38. To allow rope 38 to be slid in direction 62, the locking member 52 can be moved to a position 52*a* where ridges 54 are spaced away from rope 38 and rope 38 can slide freely in either direction 60 or direction 62.

In the illustrated embodiment, locking member 52 is biased towards its first or locking position proximate interior surface 33. As a result, unless a user manually displaces locking member 52 to a disengaged position 52*a* where locking member 52 is spaced from the rope, locking member 52 will automatically engage rope 38 and prevent rope 38 from being pulled in direction 62.

The rigid member 22 and locking member 52 of device 20 are integrally formed of a molded polymeric material. For example, EPDM rubber (ethylene propylene diene M-class rubber) is a polymeric material with weather resisting properties that can be used to form device 20. The molded polymeric material forms a living hinge 53 that joins locking member 52 to rigid member 22. Locking member 52 is molded in the first position so that living hinge 53 biases locking member 52 toward its locking position proximate surface 33. Although the illustrated device 20 is formed by molding a polymeric material, other materials and manufacturing methods may also be employed to form device 20.

Advantageously, the material used to form device 20 has a density that allows device 20 to float when it is placed in water. At least two advantages are associated with a device 20 that floats. If device 20 is accidentally dropped into the water, it will be easier to retrieve device 20 if it floats. Additionally, if the mooring post 50 is not positioned on a pier or dock but instead projects upward out of the water, the use of a device 20 that floats with such a post would maintain the device 20 on the surface of the water where it could be more easily accessed for tightening or releasing rope 38.

Figure 9:
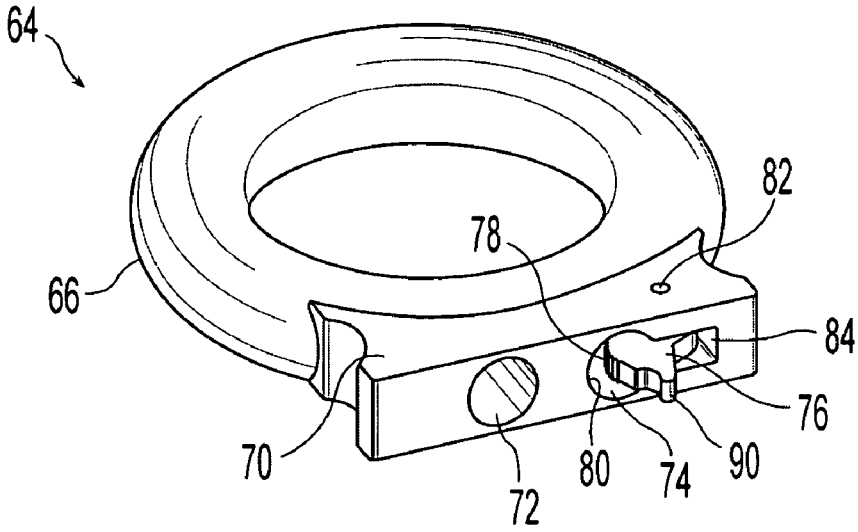
FIG. 9 is a perspective view of an alternative embodiment of the boat mooring device.
Figure 10:
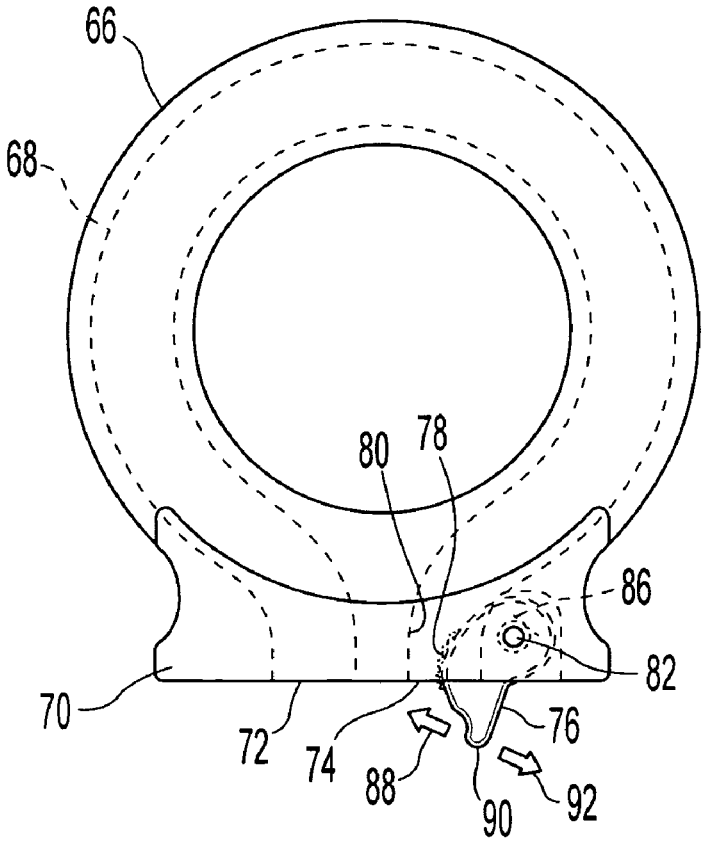
FIG. 10 is a top view of the alternative embodiment of FIG. 9.

An alternative boat mooring device 64 in accordance with the present invention is shown in FIGS. 9 and 10. Device 64 differs from device 20 in that device 64 includes a locking member 76 that is formed as a separate part that is rotatably mounted on device 64. Similar to device 20, device 64 includes a rigid member 66 defining an interior passageway 68 extending between a first port 72 and a second port 74. Ports 72, 74 are located on a projection 70 extending from the generally toroidal shaped rigid member 66. Locking member 76 is mounted within slot 84 on projection 70 proximate second port 74 with a pivot pin 82. A biasing member 86 urges locking member 76 in direction 88 to bring locking member 76 into engagement with a rope extending through device 64. The illustrated biasing member 86 is a torsion spring that is engaged with both locking member 76 and projection 70 but other forms of biasing members can also be used with device 64.

The operation of device 64 is similar to that of device 20. Locking member 76 includes a plurality of ridges 78 that are configured similar to ridges 54. When ridges 78 are engaged with a rope 38 (not shown in FIGS. 9 and 10) extending through passageway 68, the rope will be compressed between interior passageway surface 80 and the locking member 76 to prevent the rope from sliding within passageway 68 in direction from second port 74 toward first port 72 while still allowing the rope to be slid in the opposite direction. To permit the rope 38 to be slid within passageway from second port 74 toward first port 72, locking member 76 is manually displaced in direction 92 by a user to disengage the locking member 76 from the rope. Locking member 76 has a projection 90 that can be easily grasped by a user when moving locking member 76 in direction 92 out of engagement with the rope.

While this invention has been described as having an exemplary design, the present invention may be further modified within the spirit and scope of this disclosure. This application is therefore intended to cover any variations, uses, or adaptations of the invention using its general principles.

What is claimed is:

1. A boat mooring device adapted to secure a watercraft to a mooring post with a rope, said device comprising:

a rigid member forming a loop circumscribing a central opening wherein said rigid member is mountable on the mooring post by inserting the mooring post through said central opening, said rigid member defining a passageway extending between first and second ports wherein the rope is extendable through said passageway and said first and second ports, said rigid member preventing direct contact between the mooring post and the rope positioned within said passageway;

a locking member disposed on said rigid member, said locking member being moveable between first and second positions relative to said rigid member, wherein, when said locking member is in said first position, said locking member allows sliding movement of said rope through said passageway in a first direction from said first port toward said second port and inhibits sliding movement of the rope in a second direction from said second port toward said first port, and, when said locking member is in said second position, said locking member allows sliding movement of the rope in both of said first and second directions; and wherein said passageway substantially circumscribes said central opening.

2. The boat mooring device of claim 1 wherein said locking member is biased toward said first position.

3. The boat mooring device of claim 2 wherein said locking member is rotatably secured to said rigid member and a biasing member urges said locking member toward said first position.

4. The boat mooring device of claim 1 wherein said locking member includes a plurality of inclined parallel ridges having edges extending substantially perpendicular to a central axis of the rope, each of said ridges including an inclined surface facing the rope wherein said inclined surfaces form an acute angle with the rope when engaged with the rope and extend away from an associated one of said edges in said second direction, said plurality of ridges thereby allowing sliding movement of the rope against said inclined ridges in said first direction and inhibiting sliding movement of the rope against said inclined ridges in said second direction when said locking member is in said first position, movement of said locking member to said second position spacing said inclined ridges away from the rope.

5. The boat mooring device of claim 1 wherein said rigid member has a substantially toroidal shape.

6. The boat mooring device of claim 5 wherein said passageway fully encircles the rope positioned within said passageway.

7. The boat mooring device of claim 1 wherein said locking member is disposed proximate said second port.

8. The boat mooring device of claim 1 wherein the rope is compressed between an interior wall of said passageway and said locking member when said locking member is in said first position.

9. The boat mooring device of claim 8 wherein said locking member includes a plurality of inclined parallel ridges having edges extending substantially perpendicular to a central axis of the rope, each of said ridges including an inclined surface facing the rope wherein said inclined surfaces form an acute angle with the rope when engaged with the rope and extend away from an associated one of said edges in said second direction, said plurality of ridges thereby allowing sliding movement of the rope against said inclined ridges in said first direction and inhibiting sliding movement of the rope against said inclined ridges in said second direction when said locking member is in said first position, movement of said locking member to said second position spacing said inclined ridges away from the rope.

10. A boat mooring device adapted to secure a watercraft to a mooring post with a rope, said device comprising:

a rigid member forming a loop circumscribing a central opening wherein said rigid member is mountable on the mooring post by inserting the mooring post through said central opening, said rigid member defining a passageway extending between first and second ports wherein the rope is extendable through said passageway and said first and second ports, said rigid member preventing direct contact between the mooring post and the rope positioned within said passageway;

a locking member disposed on said rigid member, said locking member being moveable between first and second positions relative to said rigid member, wherein, when said locking member is in said first position, said locking member allows sliding movement of said rope through said passageway in a first direction from said first port toward said second port and inhibits sliding movement of the rope in a second direction from said second port toward said first port, and, when said locking member is in said second position, said locking member allows sliding movement of the rope in both of said first and second directions and wherein said locking member is biased toward said first position; and wherein said rigid member and said locking member are integrally formed of a molded polymeric material and said polymeric material forms a living hinge joining said locking member to said rigid member.

11. A boat mooring device adapted to secure a watercraft to a mooring post with a rope, said device comprising:

a rigid member forming a loop circumscribing a central opening wherein said rigid member is mountable on the mooring post by inserting the mooring post through said central opening, said rigid member defining a passageway extending between first and second ports wherein the rope is extendable through said passageway and said first and second ports, said rigid member preventing direct contact between the mooring post and the rope positioned within said passageway;

a locking member disposed on said rigid member, said locking member being moveable between first and second positions relative to said rigid member, wherein, when said locking member is in said first position, said locking member allows sliding movement of said rope through said passageway in a first direction from said first port toward said second port and inhibits sliding movement of the rope in a second direction from said second port toward said first port, and, when said locking member is in said second position, said locking member allows sliding movement of the rope in both of said first and second directions; and wherein said passageway fully encircles the rope positioned within said passageway.

12. The boat mooring device of claim 11 wherein said rigid member has a substantially toriodal portion and at least one projection extending outwardly from said toroidal portion, said at least one projection defining said second port and an interior wall of said passageway adjacent said second port; said locking member disposed proximate said at least one projection wherein the rope is compressed between said interior wall defined by said at least one projection and said locking member when said locking member is in said first position.

13. The boat mooring device of claim 11 wherein said rigid member and said locking member are integrally formed of a molded polymeric material and said polymeric material forms a living hinge joining said locking member to said rigid member.

14. The boat mooring device of claim 11 wherein said locking member is rotatably secured to said rigid member and a separate biasing member urges said locking member toward said first position.

15. The boat mooring device of claim 11 wherein said passageway substantially circumscribes said central opening.

16. A boat mooring device adapted to secure a watercraft to a mooring post with a rope, said device comprising:

a rigid member forming a loop circumscribing a central opening wherein said rigid member is mountable on the mooring post by inserting the mooring post through said central opening, said rigid member defining a passageway extending between first and second ports wherein the rope is extendable through said passageway and said first and second ports, said rigid member preventing direct contact between the mooring post and the rope positioned within said passageway;

a locking member disposed on said rigid member, said locking member being moveable between first and second positions relative to said rigid member and being biased toward said first position, wherein, when said locking member is in said first position, said locking member allows sliding movement of said rope through said passageway in a first direction from said first port toward said second port and inhibits sliding movement of the rope in a second direction from said second port toward said first port, and, when said locking member is in said second position, said locking member allows sliding movement of the rope in both of said first and second directions;

a plurality of inclined parallel ridges disposed on said locking member, said plurality of ridges having edges extending substantially perpendicular to a central axis of the rope, each of said ridges including an inclined surface facing the rope wherein said inclined surfaces form an acute angle with the rope when engaged with the rope and extend away from an associated one of said edges in said second direction, said plurality of ridges thereby allowing sliding movement of the rope against said inclined ridges in said first direction and inhibiting sliding movement of the rope against said inclined ridges in said second direction when said locking member is in said first position, movement of said locking member to said second position spacing said inclined ridges away from the rope; and wherein said rigid member has a substantially toriodal portion and at least one projection extending outwardly from said toroidal portion, said at least one projection defining said second port and an interior wall of said passageway adjacent said second port; said locking member disposed proximate said at least one projection wherein the rope is compressed between said interior wall defined by said at least one projection and said locking member when said locking member is in said first position.

17. The boat mooring device of claim 16 wherein said rigid member and said locking member are integrally formed of a molded polymeric material and said polymeric material forms a living hinge joining said locking member to said rigid member.

18. The boat mooring device of claim 16 wherein said locking member is rotatably secured to said rigid member and a separate biasing member urges said locking member toward said first position.

19. A boat mooring device adapted to secure a watercraft to a mooring post with a rope, said device comprising:

a rigid member having a substantially toroidal portion forming a loop circumscribing a central opening wherein said rigid member is mountable on the mooring post by inserting the mooring post through said central opening, said rigid member having at least one projection extending outwardly from said toroidal portion and defining a passageway extending between first and second ports, said second port being at least partially defined by said at least one projection and wherein the rope is extendable through said passageway and said first and second ports, said rigid member preventing direct contact between the mooring post and the rope positioned within said passageway;

a locking member disposed on said rigid member proximate said at least one projection, said locking member being moveable between first and second positions relative to said rigid member, wherein, when said locking member is in said first position, said locking member allows sliding movement of said rope through said passageway in a first direction from said first port toward said second port and compresses the rope between said locking member and an interior wall of said passageway defined by said at least one projection and thereby inhibits sliding movement of the rope in a second direction from said second port toward said first port, and, when said locking member is in said second position, said locking member allows sliding movement of the rope in both of said first and second directions; and wherein said rigid member and said locking member are integrally formed of a molded polymeric material and said polymeric material forms a living hinge joining said locking member to said rigid member.

20. The boat mooring device of claim 19 wherein said locking member includes a plurality of inclined parallel ridges having edges extending substantially perpendicular to a central axis of the rope, each of said ridges including an inclined surface facing the rope wherein said inclined surfaces form an acute angle with the rope when engaged with the rope and extends away from an associated one of said edges in said second direction, said plurality of ridges thereby allowing sliding movement of the rope against said inclined ridges in said first direction and inhibiting sliding movement of the rope against said inclined ridges in said second direction when said locking member is in said first position, movement of said locking member to said second position spacing said inclined ridges away from the rope.

* * * * *